United States Patent [19]

Knight

[11] 4,285,174

[45] Aug. 25, 1981

[54] BUILDING STRUCTURE

[76] Inventor: Brian V. Knight, 8 Pleasantview Ave., New Hartford, N.Y. 13413

[21] Appl. No.: 97,713

[22] Filed: Nov. 23, 1979

[51] Int. Cl.[3] ..... F04B 1/32

[52] U.S. Cl. ..... 52/81; 52/82

[58] Field of Search ..... 52/80–82

[56] References Cited

U.S. PATENT DOCUMENTS 3,820,292 6/1974 Fitzpatrick ..... 52/82

FOREIGN PATENT DOCUMENTS 744895 10/1966 Canada ..... 52/81

*Primary Examiner*—James L. Ridgill, Jr.

[57] ABSTRACT

The object of the invention is to provide a building structure (1) that is free-standing, clear-span, for bulk storage of materials such as fertilizer, salt, sand, grain, coal, any granular-type material that must be covered and the like. The structural uniqueness of the interface joint (21) of the building structure (1) permits such building to be of variable straight-line, convex, concave profiles, or combinations of such profiles, to spatially accommodate not only materials to be stored, but also equipment to prepare such materials for storage.

Said building structure (1) has a series of frustums, with each frustum being in and of itself an independent and self-supporting structure and with each frustum having a plurality of trapezoidal-shaped panels (5) having bottom and top plates (7) and (9). The panels (5) of a lower frustum are joined to the panels (5) of an upper frustum through their interface joints (21) of respective mating top plates (9) and bottom plates (7). Each top plate (9) forms with its panel (5) an interior angle (23) greater than 90 degrees and the planes of the interface joints (21) of such joined-together top and bottom plates (9) and (7) all lie below and outside the imaginary horizontal plane (25) of the building structure (1) thereby contributing to the solution of two problems of the art: hinge moment at the joints causing inward building collapse, and shear and sliding forces acting at the joints.

9 Claims, 13 Drawing Figures

BUILDING STRUCTURE

TECHNICAL FIELD

This invention relates to a building structure for bulk storage of materials such as fertilizer, salt, sand, grain, coal, any granular-type material that must be covered and the like.

DISCLOSURE OF INVENTION

In accordance with the present invention, a building structure is provided, but is not countenanced in the prior art, in the form of a series of frustums, bolted and otherwise joined together. Each frustum, in and of itself, is an independent and self-supporting structure. Each frustum has a plurality of trapezoidal-shaped panels joined together. The top plate of a panel of a lower-disposed frustum is joined to a mating bottom plate of a panel of a upper-disposed frustum. Such top plate forms an interior angle of more than 90 degrees with its panel, and, in addition, the plane of such joined-together top and bottom plates must lie below and outside the plane of the building structure itself to obviate any problems arising of "hinge moment" to cause inward collapse at the joint, and any problems from shear and sliding forces which act at the building joints that are horizontally disposed. Since less material and fewer fastenings must be employed to hold the building together, considerable savings in not only material but labor costs result.

The phenomenon of this invention and the construction, angular arrangement and disposition of its joined-together top and bottom panel plates not only permits such building structure to be a free-standing, clear-span building, but also permits such building to be of variable profiles and combinations of such profiles, such as straight-line, convex, concave.

Since the building is free-standing, this allows the building to be erected at any location whether or not another structure or other types of support are available. Bulk material such as salt and sand are stored in remote areas where other buildings or support are non-existent.

The building in this invention is clear-span. A clear-span building allows greater storage capacity for materials and minimizes structural damage to the building when heavy equipment such as payloaders and bulldozers are used inside the building.

Bulk materials such as salt, sand, potash, sulphate, etc. all have differing angles of repose when stored in a "free pile". Therefore, to efficiently cover the different materials without undue wasted space, a variable profile is necessary. Since some materials soak up moisture from the air, the closer the building profile is to the particular material's angle of repose, the better. Not only can the profile of the building be varied, but also combinations of such profiles—straight-line, convex, concave—can be effected in one building. In other words, the profile may start as an outward bulge, change to a straight-line profile and finish with a concave profile. Such profile or combinations can be effected for reason of the unique interface design and interior angle of the panel top plate of a lower frustum with the mating panel bottom plate of the upper frustum.

Such profile or combinations of same permits the profile of such building to be tailor-made for storing not only particular kinds of materials, but also for spatially accommodating certain functions to be performed for preparing such material for storage, such as equipment disposed in such building for use in drying grain to be stored, and thereupon storing such dried grain in the same building. Should it be desired to load the building by use of a conveyor through an opening at the top of the building to spread such grain over a surface or system that removes moisture from the grain before allowing the grain to fall in a free pile on the building floor, the top portion of the building would have to be larger than normal to spatially accommodate such equipment. Hence, such spatial accommodation would require a corresponding profile design change for the top portion of the building to house such equipment therein. Should the end-user of the building further require that the building be profiled to accommodate mechanical means for removal of such stored grain, such use of the building may require a combination profile starting as an outward bulge, straightening and then change to a concave profile to spatially accommodate and cover drying equipment.

This invention makes further contributions to the art in that the building structure is made-up of factory-manufactured, prefabricated building panels that can easily be transported to the building site and from one place to another. This permits the main construction work of the building to be performed under ideal conditions where weather is not a factor, such as inside a manufacturing plant. Since the building components are such that standard-type trucks can readily transport them, no special hauling permits are necessary.

The panels for each individual frustum can be assembled on the ground at the building site without the need for any further bracing or support. Since each frustum is, in effect, an independent and self-supporting, rigid structure, each frustum can be lifted by crane, or other suitable mechanical means, and be disposed for assembly and for being joined to the frustum immediately below it. This obviates the need for erection crews from working at great heights with resulting time and money saved in labor costs.

Further savings are achieved through this invention because common building materials such as lumber and plywood are used, and for the reason that the design can readily be reworked to form a panel with unsophisticated equipment.

BRIEF DESCRIPTION OF DRAWINGS

The details of the invention will be described in connection with the accompanying drawings, in which.

BEST MODE FOR CARRYING OUT THE INVENTION

Figure 1:
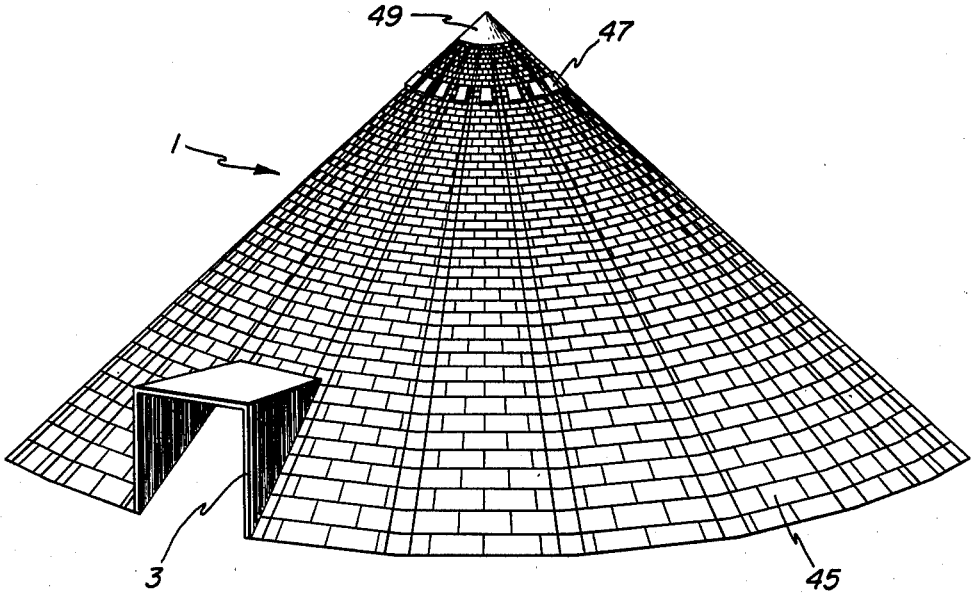
FIG. 1 is a perspective view of the invention.
Figure 2:
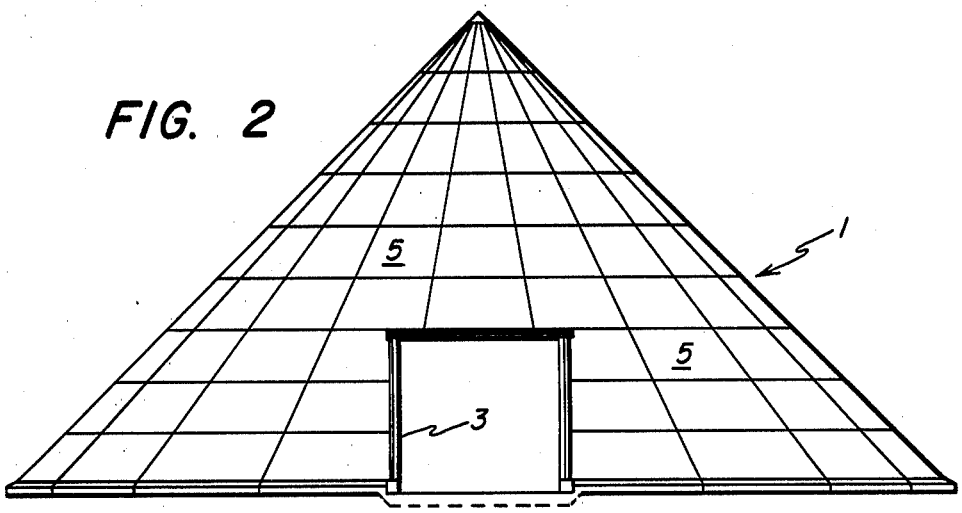
FIG. 2 is a front view of the invention shown in FIG. 1 but without the asphalt roofing shingles.

In FIG. 1 of the drawings, reference numeral 1 generally refers to the free-standing, self-supporting, clear-span building structure for bulk storage of materials such as fertilizer, salt, sand, grain, coal, any granular-type material that must be covered, and the like. The structure 1 shown in FIGS. 1, 2, 6 and 7 is of pyramidal configuration with straight-line sides rising from a base of polygonal configuration. The structure 1 has an entrance 3 of suitable dimensions to admit vehicles and equipment to unload and store materials, and to remove stored materials therefrom.

The building structure 1 comprises a series of mating frustums bolted or otherwise suitably joined together. Each frustum has a plurality of similar and uniform panels 5, trapezoidal in shape, bolted or otherwise suitably joined together. Each frustum, in and of itself, constitutes an independent and self-supporting structure.

Figure 3:
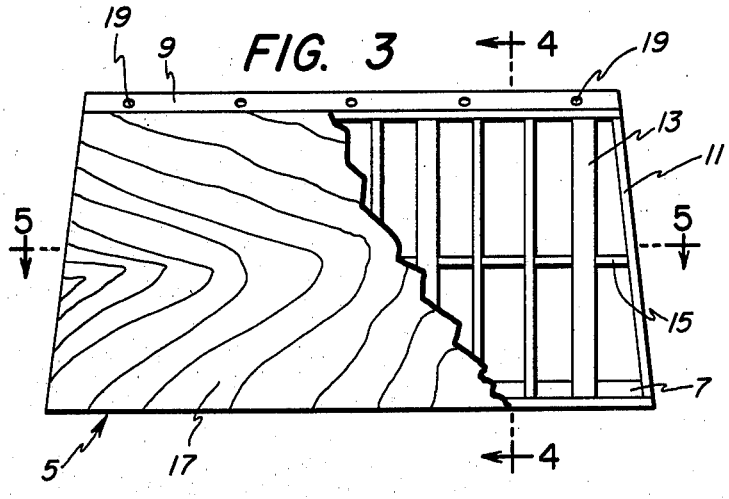
FIG. 3 is a view of a representative modular panel utilized in the construction of the Building.
Figure 4:
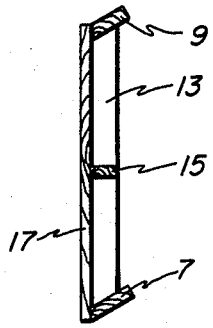
FIG. 4 is a sectional view taken along the line 4—4 in FIG. 3.
Figure 5:
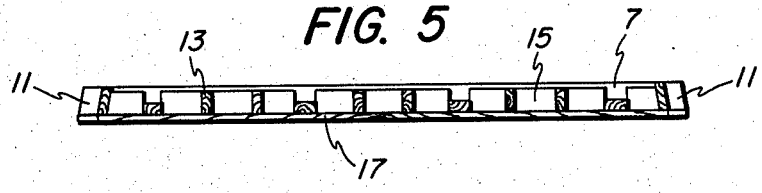
FIG. 5 is a sectional view taken along the line 5—5 in FIG. 3.
Figure 6:
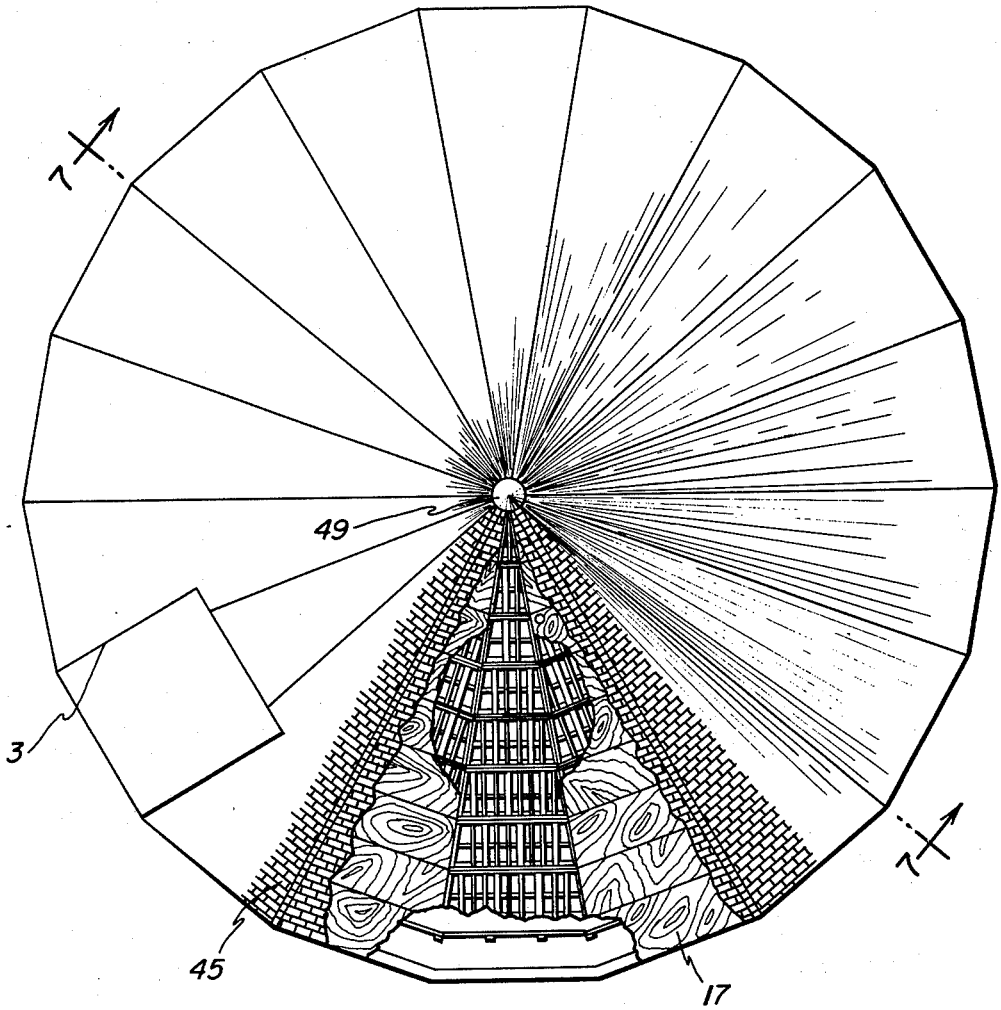
FIG. 6 is a top view of the invention shown in FIG. 1, with portions partly broken-away.

Each of the panels of a lower-disposed frustum has an external surface area that is greater than the external surface area of a panel of the next succeeding upper-disposed frustum. Each panel 5 comprises a bottom plate 7, top plate 9, lateral plates 11, studs 13, bridging 15 and a flat, plywood skin 17. The bottom plate 7, top plate 9 and lateral plates 11 of each panel 5 are suitably joined together such as by nailing, gluing and the like to form a flat, superstructure to which the flat, plywood skin 17 is joined. Studs 13 are suitably joined to the bottom plate 7 and top plate 9 such as by nailing, gluing and the like. Since plywood comes in uniform dimensions of 4 by 8 feet, FIGS. 3 and 5 depict some of the studs 13 disposed on their sides, 4 feet on their centers, to present thereby a greater surface area upon which to nail, glue or fix the plywood thereto. Solid bridging 15 disposed, as shown, between the lateral plates 11 and studs 13, and suitably joined thereto such as by nailing, gluing and the like, provides thereby strength and structural rigidity for such panel 5. The plywood skin 17 is suitably joined to the superstructure of the bottom plate 7, top plate 9, lateral plates 11, studs 13 and bridging 15 by gluing, nailing and the like. Each panel 5 has holes 19 formed through their plates. Such holes 19 are correspondingly aligned with adjacent holes in plates of mating lateral panels of such frustum, and, similarly, are correspondingly aligned with mating plates of panels in upper and lower disposed frustums, in order that the panels of a frustum can be joined together and in order that the assembled frustums can be joined to mating frustums.

Figure 10:
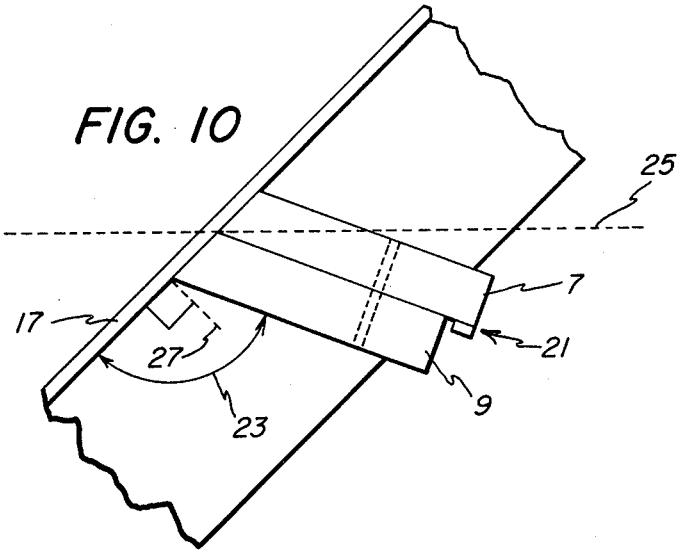
FIG. 10 shows an enlarged detail view of a typical interface joint of top and bottom plates, and shows that the interior angle that the top plate forms with its panel is greater than 90 degrees and that the interface of such top and bottom plates lies below and outside the imaginary horizontal plane of the building.

In FIG. 10 of the drawings, reference numeral 21 generally refers to a typical interface joint when a top plate 9 of a lower frustum is joined to the bottom plate 7 of a panel of a mating upper frustum. Each of the panels 5 is constructed so that the top plate 9 of a panel of a lower frustum will lie flat upon and engage its mating bottom plate 7 of the panel of the upper frustum. Hence, the upper surface of such top plate 9 will be coplanar with the bottom surface of such bottom plate 7 to form such interface joint 21. Such joint 21 must observe two critical conditions. The first condition is that the interior angle 23 which such top plate 9 of the panel of such lower frustum forms with its plywood skin 17 must be an obtuse angle or greater than 90 degrees; and the second condition is that the interface plane of such joined-together top and bottom plates 9 and 7 must be so disposed that it lies below and outside of the imaginary horizontal plane 25 of the building structure 1. For the sake of further clarity, an imaginary line 27 is shown drawn normal to the plywood skin 17 of panel 5.

Assume for the sake of discussion of the first condition that the interior angle 23 which top plate 9 of the panel of the lower frustum forms with its plywood skin 17 were 90 degrees. Since the sloped exterior profile of the building structure shown in FIG. 10 is straight, the bottom plate 7 of the panel of such upper frustum would similarly form an angle of 90 degrees with its plywood skin 17. Such resulting 90 degree joint angle would constitute a hinge moment and the building would tend to collapse inwardly at this joint and at such other similarly disposed 90 degree joints.

Assume for the sake of discussion of the second condition that the building is now constructed such that the plane of the interface joint 21 of each top plate 9 joined together with its mating bottom plate 7 lies within the imaginary horizontal plane 25 of such building or that the plane of such interface joint 21 is coplanar with the imaginary horizontal plane 25 of such building. Such arrangement, construction and disposition of such interface joint 21 would result in the problems of shear forces and sliding forces acting at such horizontally disposed joints of the building; and, at considerable expense, attempts would have to be made to overcome these problems of shear and sliding forces by employing additional joint material of sufficient structural strength and by employing additional joint fastenings to hold the joints and thereby to hold the building itself together.

It should have been discerned and appreciated from the foregoing description and discussion that this invention makes a unique contribution to solving the problems of the art by arranging and constructing the panels 5 such that the interior angle 23 which each top plate 9 forms with its plywood skin 17 is greater than 90 degrees while at the same time the plane of each of the interface joints 21 of such top and bottom plates 9 and 7 will lie below and outside the imaginary plane 25 of the building. Thus, contributing to the solution of both problems: hinge moment at the joints causing inward building collapse, and shear and sliding forces acting at the joints. This invention also achieves considerable savings because less material and fewer fastenings must be employed to hold the joints and building together, along with considerable savings in labor costs.

Figure 11:
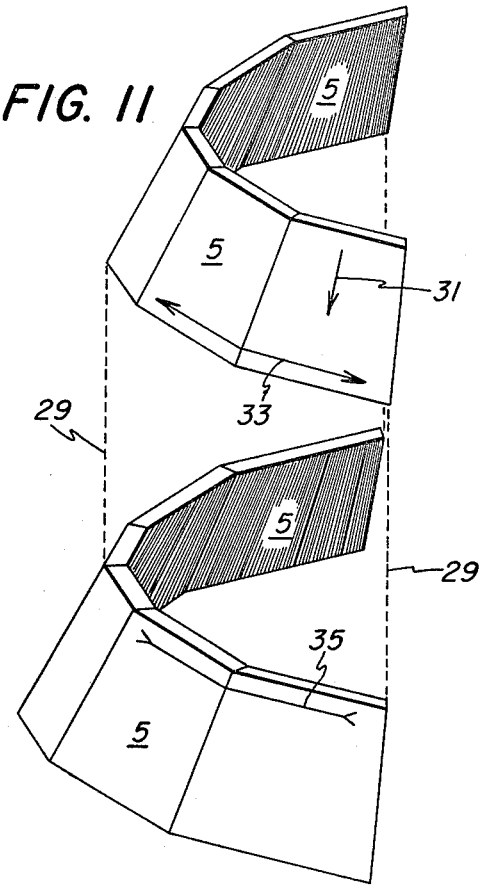
FIG. 11 is a perspective view of upper and lower frustums before loading the upper on top of the lower.

FIG. 11 is a perspective view of portions of two individual frustums of panels 5 before loading one on top of the other, as indicated by the dashed lines 29. The arrows 31, 33 and 35 indicate the directions of the forces as to static loading, reacting tensile and compression, respectively.

Figure 12:
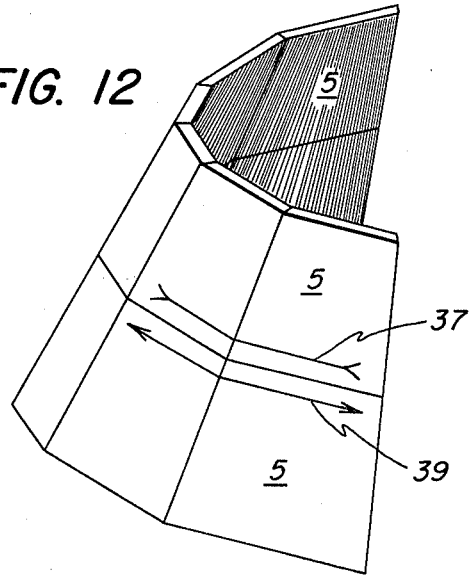
FIG. 12 is a perspective view of a portion of an upper frustum loaded upon its mating lower frustum.

FIG. 12 is a perspective view of portions of two of such individual frustums of panels 5 joined together and indicates thereon the transference of compression and tensile forces which are indicated by arrows 37 and 39, respectively. When such frustums are joined together, such tensile and compression forces 33 and 35 are converted to opposite reacting compression and tensile forces 37 and 39 because of the phenomenon of the particular and unique joint interface angle 21 utilized in this invention.

Figure 13:
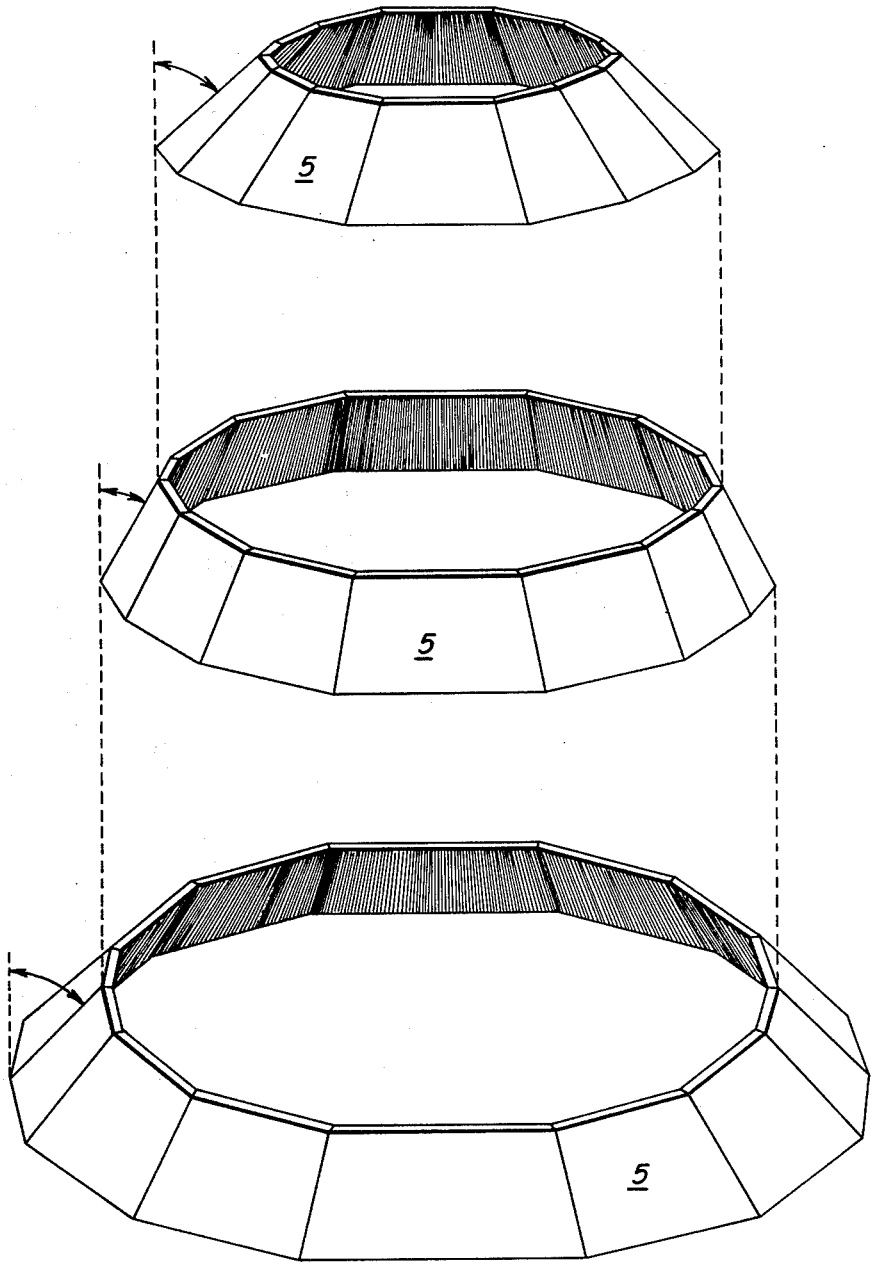
FIG. 13 is a perspective view of three frustums in a potential loading mode and further depicts the angular changes in panel and hence frustum construction possible to produce a resulting variable profile for a building.

FIG. 13 is a perspective view of three individual frustums of panels 5 in a potential loading mode and depicts the angular slope changes of panel construction to produce a building of variable profile.

Figure 7:
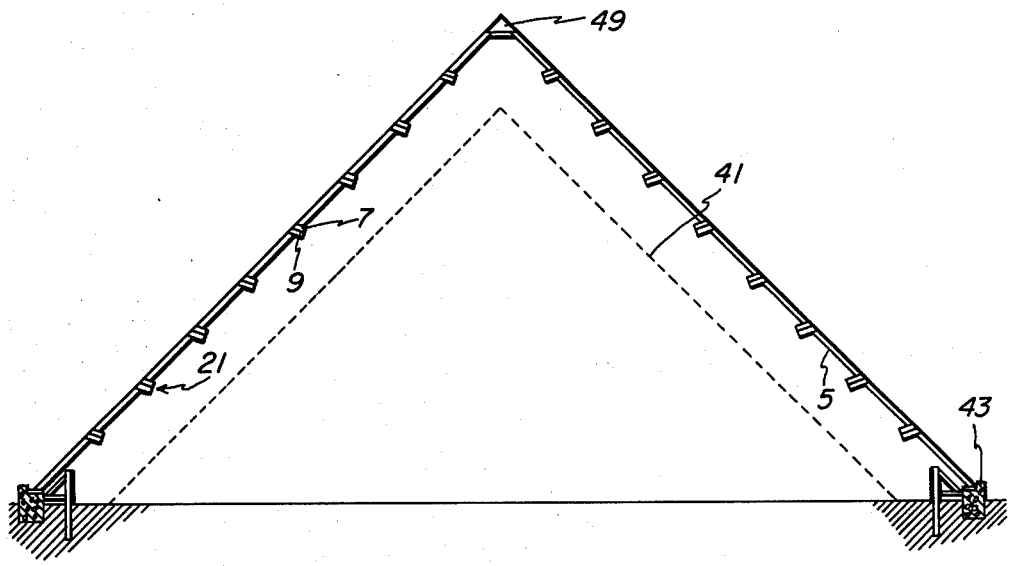
FIG. 7 is a sectional view taken along the line 7—7 in FIG. 6.

Since the normal profile of bulk material when stored is a straight line (the angle of repose of such stored material is indicated by reference numeral 41 applied to the dashed lines), the pyramidal configuration, as shown in FIG. 7, is "normally" employed. FIG. 7 depicts the lowermost portion of the frustum joined to a conventional base 43, such as a concrete footing.

The plywood skin 17 is covered by conventional asphalt shingles 45. In FIG. 1, the structure is shown as being provided with vents or windows 47. The peak of the structure has a cap 49 of any suitable construction.

Figure 8:
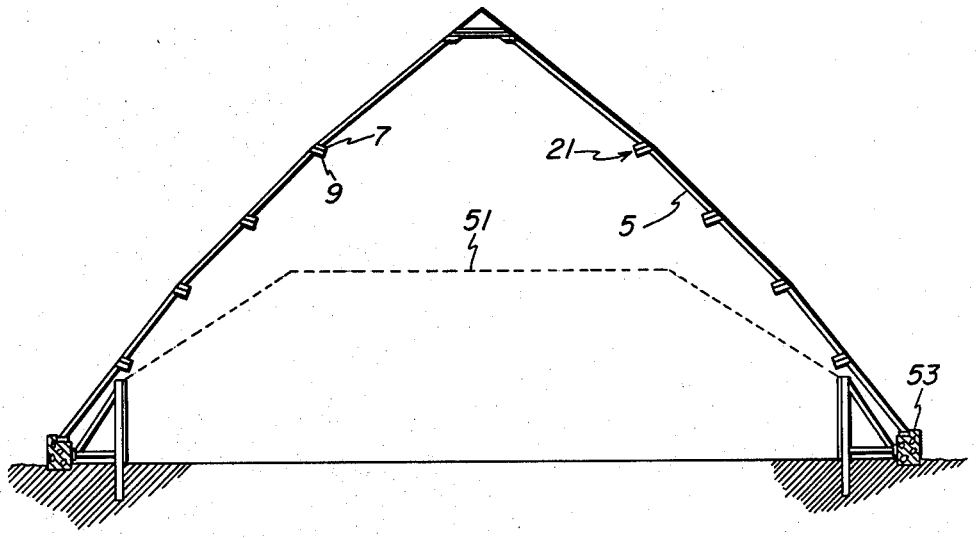
FIG. 8 represents what a sectional view of a modification of the building profile would depict.

FIG. 8 depicts a building structure of variable profile to accommodate stored bulk material having an angle of repose indicated by reference numeral 51 applied to dashed lines. The lowermost frustum is joined to a conventional base 53, such as a concrete footing. The peak of the structure has a cap 55 of any suitable construction. The structure shown in FIG. 8 similarly has a series of frustums bolted or otherwise suitably joined together with each frustum having a plurality of uniform panels, trapezoidal in shape, that are bolted or otherwise suitably joined together. Nevertheless, each panel has a flat outermost plywood skin. Similarly, each frustum, in and of itself, constitutes an independent and self-supporting structure.

Figure 9:
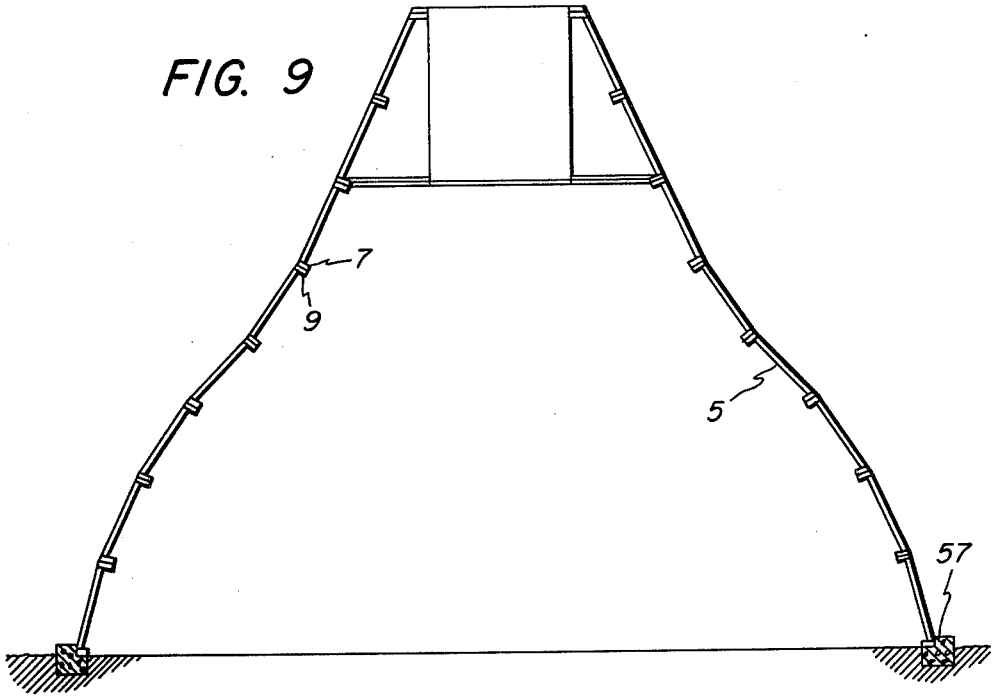
FIG. 9 represents what a sectional view of another modification of the building profile would depict.

FIG. 9 depicts a building structure of combination profiles achieved by employment of frustums, their panels and the unique joint interfaces of this invention. The building profile can be any combination of convex, concave or straight-line. The building profile in FIG. 9 was designed for the functional purpose of loading grain from the top, drying it and allowing it to descend for storage. The lowermost frustum is joined to a conventional base 57, such as a concrete footing. The structure has a series of frustums bolted or otherwise suitably joined together with each frustum having a plurality of uniform panels, trapezoidal in shape, bolted or otherwise suitably joined together. Each panel has a flat outermost, plywood skin. Similarly, each frustum, in and of itself, constitutes an independent and self-supporting structure.

INDUSTRIAL APPLICABILITY

As should now be obvious from the description and nature of the building structure 1 of this invention, same can be utilized and exploited by industries, farms, municipalities, etc. for bulk storage of materials such as fertilizer, salt, sand, grain, coal, and any granular-type material that must be covered, and the like. The structural uniqueness of the interface joints 21 of the building structure 1 not only permits same to be a free-standing, clear-span building, but also permits such building to be of variable straightline, convex, concave profiles, or combinations of such profiles, not only to spatially accommodate the materials to be stored, but also to permit the building profile to be tailor-made in its design to spatially accommodate equipment, etc. for operations to be performed to prepare such material for storage. For example, the building can be tailor-made in its profile design to spatially accommodate equipment to dry grain for purposes of storage and to store such dried grain.

I claim:

1. A trapezoidal-shaped panel for use with a frustum of a free-standing building structure of variable profile, said frustum being, in and of itself, an independent and self-supporting structure, said building structure having a plurality of frustums, each of said frustums having a plurality of said trapezoidal-shaped panels joined together, each of the panels of a lowerdisposed frustum having a greater external surface area than a panel of the next succeeding upper-disposed frustum, each panel having a flat, outer or exterior skin and a superstructure of a bottom plate, top plate and lateral plates, said superstructure carrying said skin, each of said frustums having its panels joined together along and at their common lateral plates, said top plates of said panels of a lower-disposed frustum being joined to corresponding bottom plates of mating panels of such next succeeding upper-disposed frustum, and each of said top plates forming with its respective outer or exterior skin an interior angle greater than 90 degrees and with the interface plane of each of such joined-together top and bottom plates being disposed lying below and outside the horizontal plane of the building structure.

2. A panel of claim 1 wherein said panel includes studding and wherein said studding is disposed between said top and bottom plates.

3. A panel of claim 2 wherein said panel includes bridging and wherein said bridging is disposed between said lateral plates and studding.

4. A frustum for use in a free-standing building structure of variable profile, said frustum, being in and of itself, an independent and self-supporting structure, said building structure having a plurality of frustums, each of said frustums having a plurality of trapezoidal-shaped panels joined together, each of the panels of a lower-disposed frustum having a greater external surface area than a panel of the next succeeding upperdisposed frustum, each panel having a flat, outer or exterior skin and a superstructure of a bottom plate, top plate and lateral plates, said superstructure carrying said skin, each of said frustums having its panels joined together along and at their common lateral plates, said top plates of said panels of a lower-disposed frustum being joined to corresponding bottom plates of mating panels of such next succeeding upper-disposed frustum, and each of said top plates forming with its respective outer or exterior skin an interior angle greater than 90 degrees and with the interface plane of each of such joined-together top and bottom plates being disposed lying below and outside the horizontal plane of the building structure.

5. A frustum of claim 4 wherein each panel includes studding and wherein said studding is disposed between said top and bottom plates.

6. A frustum of claim 5 wherein said panel includes bridging and wherein said bridging is disposed between said lateral plates and studding.

7. A free-standing building structure of variable profile comprising a plurality of frustums, each of said frustums being, in and of itself, an independent and self-supporting structure, each of said frustums having a plurality of trapezoidal-shaped panels joined together, each of the panels of a lower-disposed frustum having a greater external surface area than a panel of the next succeeding upper-disposed frustum, each panel having a flat, outer or exterior skin and a superstructure of a bottom plate, top plate and lateral plates, said superstructure carrying said skin, each of said frustums having its panels joined together along and at their common lateral plates, said top plates of said panels of a lower-disposed frustum being joined to corresponding bottom plates of mating panels of such next succeeding upper-disposed frustum, and each of said top plates forming with its respective outer or exterior skin an interior angle greater than 90 degrees and with the interface plane of each of such joined-together top and bottom plates being disposed lying below and outside the horizontal plane of the building structure.

8. A building structure of claim 7 wherein each panel includes studding and wherein said studding is disposed between said top and bottom plates.

9. A building structure of claim 8 wherein said panel includes bridging and wherein said bridging is disposed between said lateral plates and studding.

* * * * *